US007635298B2

(12) United States Patent
Henneberry

(10) Patent No.: US 7,635,298 B2
(45) Date of Patent: Dec. 22, 2009

(54) AIR DEFLECTOR

(76) Inventor: Gary A. Henneberry, 19 Parkmoor Avenue, Halifax, Nova Scotia (CA) B3R 1B5

( * ) Notice: Subject to any disclaimer, the term of this patent is extended or adjusted under 35 U.S.C. 154(b) by 0 days.

(21) Appl. No.: 11/897,288

(22) Filed: Aug. 30, 2007

(65) Prior Publication Data

US 2009/0042505 A1 Feb. 12, 2009

(30) Foreign Application Priority Data

Aug. 9, 2007 (CA) ..... 2596767

(51) Int. Cl.
*F24F 13/06* (2006.01)
*F24F 13/08* (2006.01)
*F24F 13/00* (2006.01)

(52) U.S. Cl. ..... 454/307; 454/284; 454/292; 454/306; D23/387; D23/388

(58) Field of Classification Search ..... 454/292, 454/296, 302, 307, 358, 284, 306; D23/387, D23/388

See application file for complete search history.

(56) References Cited

U.S. PATENT DOCUMENTS 1,622,031 A * 3/1927 Elters ..... 454/289
1,855,588 A * 4/1932 Pritchard ..... 160/131
2,080,726 A * 5/1937 Lowinger ..... 55/511
2,161,001 A * 6/1939 Bedol ..... 454/291
2,696,154 A * 12/1954 Eaton ..... 454/135
3,225,679 A * 12/1965 Meyer ..... 454/289
3,358,578 A * 12/1967 Meyer ..... 454/307
3,768,235 A * 10/1973 Meyer et al. ..... 55/385.5
D271,900 S * 12/1983 Efstratis ..... D23/387
D281,999 S * 12/1985 Shames et al. ..... D23/391
4,602,556 A * 7/1986 Gladden ..... 454/307
4,655,120 A * 4/1987 Lemmo ..... 454/292
4,693,174 A * 9/1987 Anderson ..... 454/292
6,308,480 B1 * 10/2001 Haney ..... 52/302.6
6,435,963 B1 * 8/2002 Dill ..... 454/292
6,745,518 B2 * 6/2004 Weakes et al. ..... 52/22

* cited by examiner

*Primary Examiner*—Steven B McAllister
*Assistant Examiner*—Patrick F. O'Reilly, III
(74) *Attorney, Agent, or Firm*—Thompson Hine LLP

(57) ABSTRACT

An air deflector adapted for insertion at an air vent positioned and supported by supporting shoulders of main runners and cross tees of a suspended ceiling including at least one support surface adapted for engagement with and supported by a supporting shoulder and a deflector surface in engagement with and supported by the at least one support surface and adapted to direct the flow of air from the air vent.

8 Claims, 5 Drawing Sheets

AIR DEFLECTOR

This application claims priority from Canadian Patent Application No. 2,596,767 entitled "Air Deflector" filed on Aug. 9, 2007, the entire contents of which are incorporated herein by reference.

FIELD OF INVENTION

The present invention relates to air deflectors, and more particularly relates to air deflectors for use in overhead air distribution systems within buildings.

BACKGROUND

Many buildings, and particularly many modern buildings have centrally supplied heated and cooled air supplies, which are distributed through the building by way of one or more overhead air ducts which are often positioned above a suspended ceiling, the air being expelled from the air ducts into that area of the building proximate the outside of the air duct, through, for example, overhead air vents which distribute by way of an air diffuser, the supplied air to an area proximate the air vent.

However, many of these air diffusers distribute the air therefrom in a generally uniform manner in all directions, which may be desirable in some circumstances, and undesirable in other circumstances. For example, significant volumes of heated or cooled air may, undesirably, be distributed in all directions, including in the direction of individuals who are stationed beneath or near these air diffusers, resulting in significant, and sometimes undesirable warm or cold air drafts, as a result of which, some occupants in the building may experience discomfort during the normal operation of the central air distribution system.

It is desirable to provide a system and method of reducing or eliminating unwanted or undesirable drafts of air in the area proximate the air vent/diffuser.

It is also desirable to provide a device which may be readily and securely inserted in position proximate the air vent/diffuser without damaging or altering the preexisting duct work or air distribution system.

SUMMARY

Accordingly, one object of the present invention is to provide an air deflector for reducing or eliminating unwanted or undesirable drafts of air in the area proximate the air vent and air diffuser.

Another object of the present invention is to provide an air deflector which may be readily and securely inserted in position proximate the air vent and air diffuser without damaging or altering the preexisting duct work or air distribution system.

According to one aspect of the present invention, there is provided an air deflector adapted for insertion at an air vent and air diffuser positioned and supported by supporting shoulders of main runners and cross tees of a suspended ceiling, comprising, at least one support surface adapted for engagement with and supported by a supporting shoulder, and a deflector surface in engagement with and supported by the at least one support surface and adapted to direct the flow of air from the air vent and air diffuser.

The advantage of the present invention is that it provides an air deflector for reducing or eliminating unwanted or undesirable drafts of air in the area proximate the air vent and air diffuser.

A further advantage of the present invention is that it provides an air deflector which may be readily and securely inserted in position proximate the air vent and air diffuser without damaging or altering the preexisting duct work or air distribution system.

BRIEF DESCRIPTION OF THE DRAWINGS

A preferred embodiment of the present invention is described below with reference to the accompanying drawings, in which.

DETAILED DESCRIPTION

Figure 5:
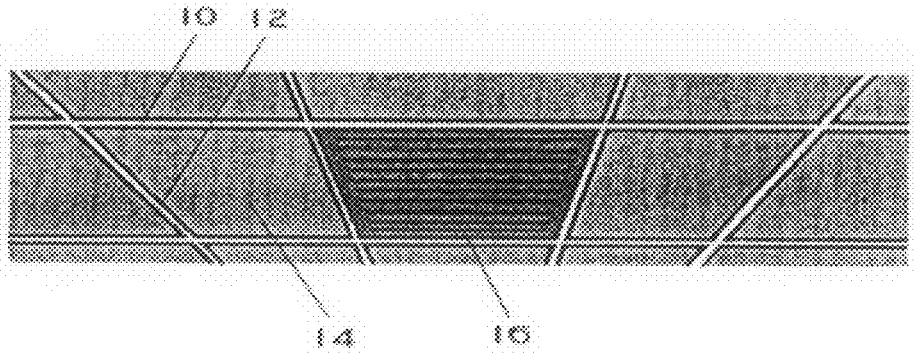
FIG. 5 is a view of a suspended ceiling, with an air diffuser positioned therewithin.

In one embodiment of the present invention, with reference to FIGS. 1, 2, 3, and 4 an air deflector is provided, preferably made of plastic or alternatively made of aluminum, steel or such other material as would be known to a person skilled in the art. The air deflector of the present invention is adapted for installation, for example, closely proximate to an air diffuser or air duct installed in a building having a suspended ceiling. For example, as illustrated in FIGS. 5 and 7, suspended ceilings having tile panels 14 which are generally supported by an arrangement of main runners 10 running parallel to one another and cross tees 12 running perpendicular to the main runners, the main runners 10 and cross tees 12 are suspended from the main ceiling by wires or other devices known to a person skilled in the art, the main runners 10 and cross tees 12 having supporting shoulders 10A and 10B to support the tile panels 14 and air diffusers 16 for air ducts and ventilation systems in a manner known to a person skilled in the art. and 7, suspended ceilings having tile panels 14 which are generally supported by an arrangement of main runners 10 running parallel to one another and cross tees 12 running perpendicular to the main runners, the main runners 10 and cross tees 12 which are suspended from the main ceiling by wires or other devices known to a person skilled in the art, the main runners 10 and cross tees 12 having supporting shoulders 10A and 10B to support the tile panels 14 and air diffusers 16 for air ducts and ventilation systems in a manner known to a person skilled in the art.

Figure 1:
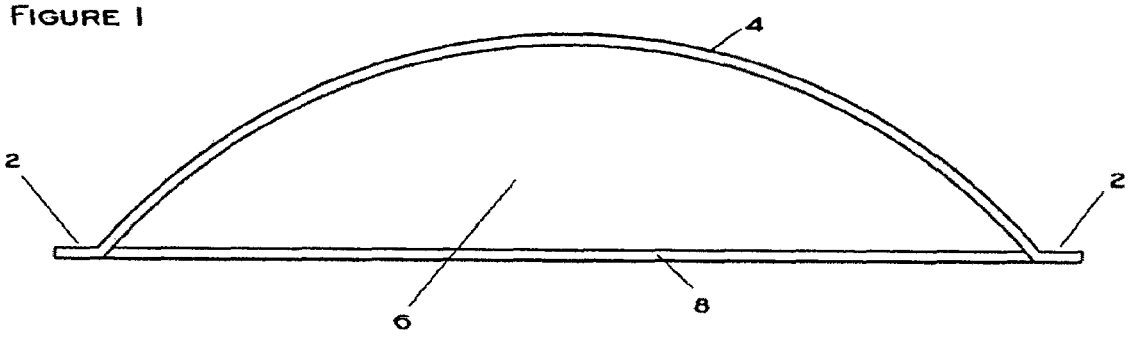
FIG. 1 is a front view of one embodiment of the present invention.
Figure 2:
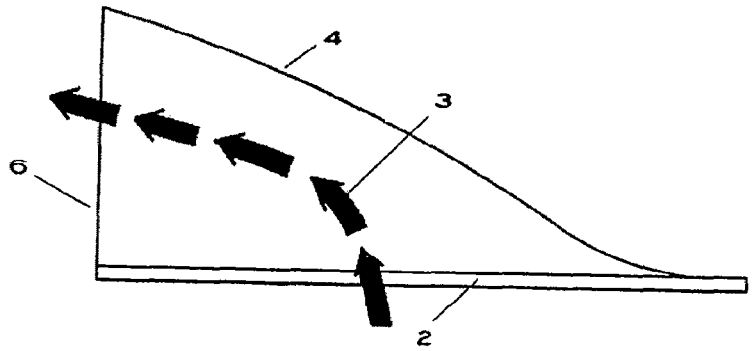
FIG. 2 is a side view of one embodiment of the present invention.
Figure 3:
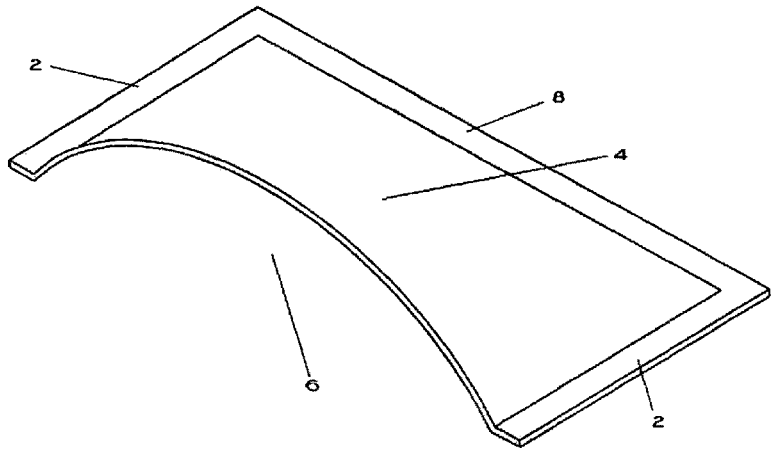
FIG. 3 is a perspective view of one embodiment of the present invention.
Figure 4:
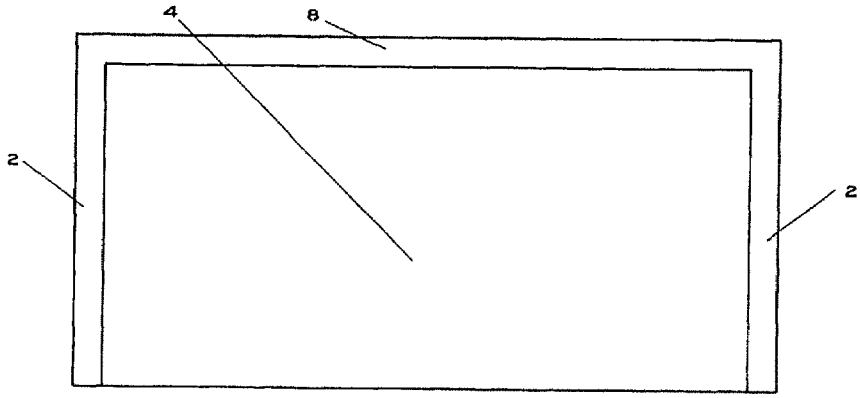
FIG. 4 is a top view of one embodiment of the present invention.
Figure 10:
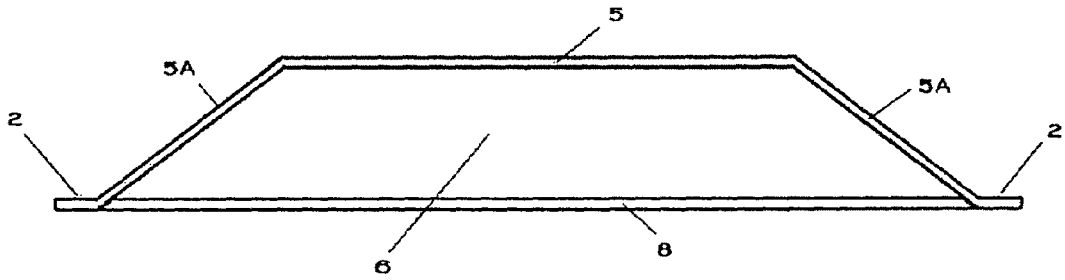
FIG. 10 is a front view of an alternative embodiment of the present invention.
Figure 11:
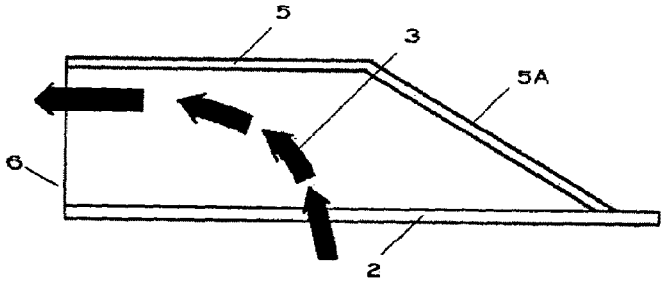
FIG. 11 is a side view of an alternative embodiment of the present invention.

In the preferred embodiment of the present invention, the air deflector as illustrated in FIGS. 1, 2, 3, 4 and 8 has one or more side support surfaces 2 and an end support surface 8, and a deflecting surface 4, which preferably is gently curved as illustrated in FIGS. 1, 2, and 3, it being understood that in alternative embodiments, flat or substantially flat deflecting surfaces 5 and 5A may be utilized, as for example, illustrated in FIGS. 10 and 11.

Figure 7:
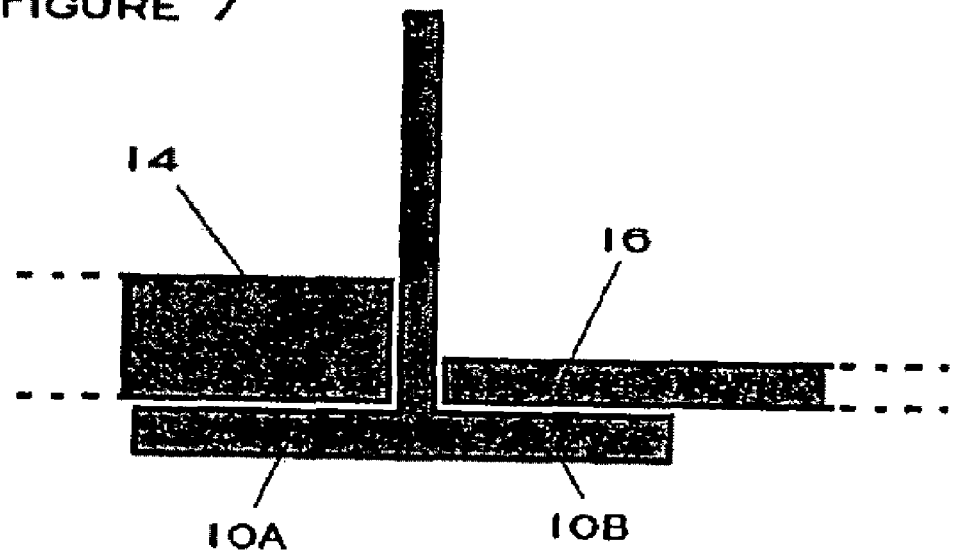
FIG. 7 is a cross-sectional view of the main runner support for a suspended ceiling supporting a ceiling tile panel and an air diffuser.

Prior to the installation of the air deflector, one end of the air diffuser 16 (which is normally supported by the supporting shoulder 10B as illustrated in FIG. 7) is raised slightly (for example, by an individual standing on a ladder, and manually raising the air diffuser a short distance). Once the air diffuser 16 has been raised slightly, the air deflector is positioned so that the side support surfaces 2 and end support surface 8 of the air deflector are stably and securely positioned on the supporting shoulders of the main runners 10 and cross tees 12, and the air diffuser 16 may be lowered back into position on top of the air deflector as illustrated in FIG. 8.

Figure 6A:
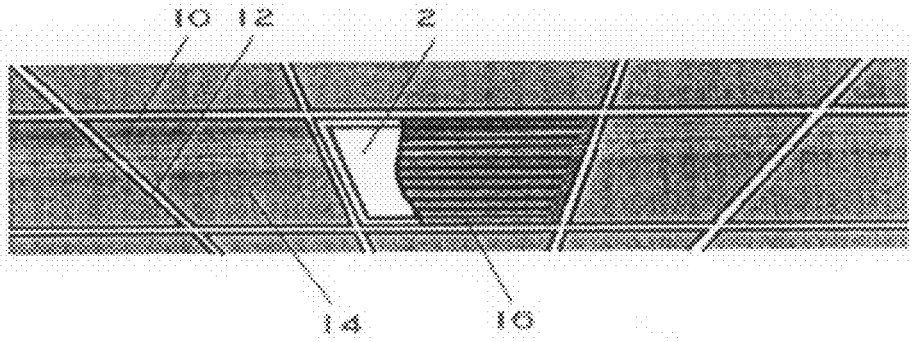
FIG. 6A is a view of a suspended ceiling, with an air diffuser positioned therewithin, and an air deflector of one embodiment of the present invention positioned proximate the air diffuser.

In this manner, the weight of the air diffuser 16 keeps the air deflector in the installed location, reducing the likelihood that it will move after installation. As illustrated in FIG. 6A, the air deflector is positioned to redirect airflow (as illustrated by the arrows 3 in FIG. 2, or in an alternative embodiment, as illustrated by the arrows 3 in FIG. 11) away from an undesired location and out through the opening 6 at the front of the air deflector, the redirected airflow from the air diffuser being directed to the desired location by the air deflector.

Figure 6B:
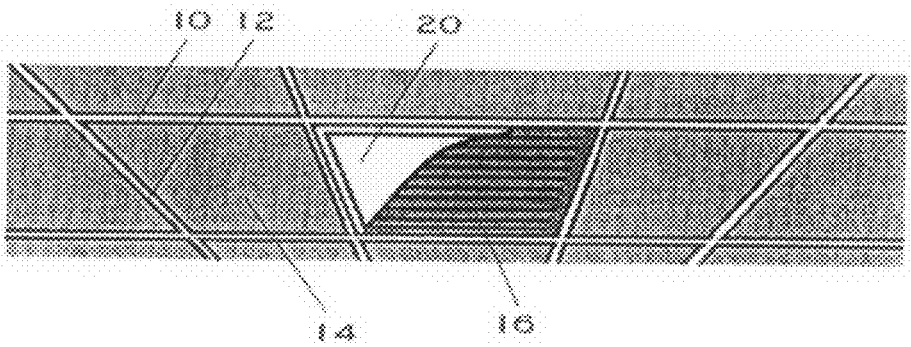
FIG. 6B is a view of a suspended ceiling, with a air diffuser positioned therewithin, and an air deflector of an alternative embodiment of the present invention positioned proximate the air diffuser.
Figure 8:
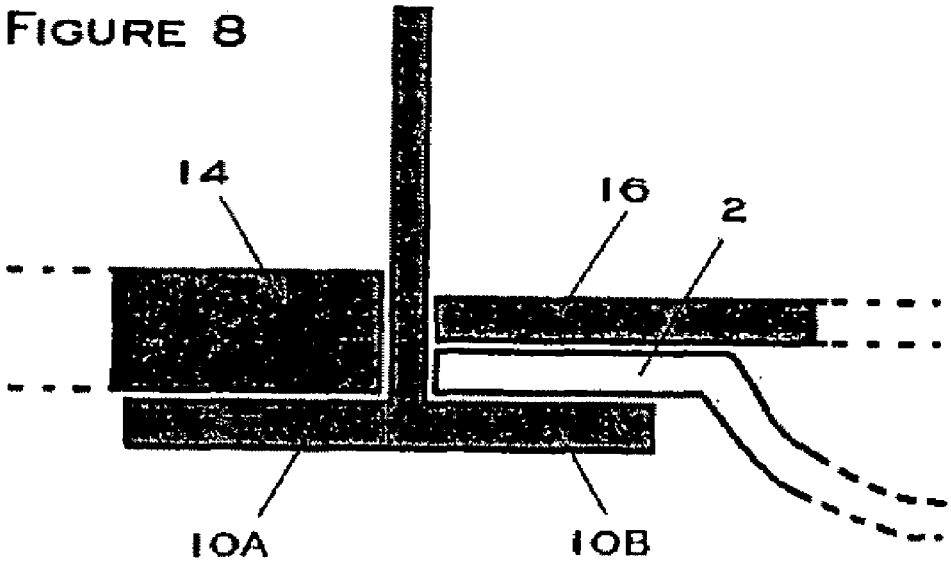
FIG. 8 is a cross-sectional view of the main runner support for a suspended ceiling supporting a ceiling tile panel and an air diffuser and an air deflector of one embodiment of the present invention positioned on the support.
Figure 9:
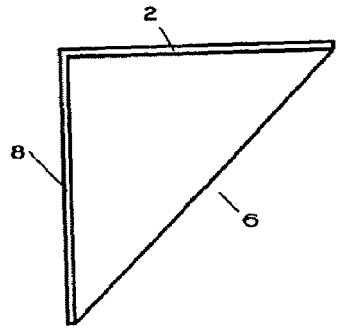
FIG. 9 is an alternative embodiment of an air deflector of the present invention.

In an alternative embodiment of the present invention, a generally triangularly-shaped air deflector is provided as illustrated in the top view of FIG. 9, and which when positioned beneath the air diffuser as illustrated in FIG. 6B (a corner of the air diffuser being raised slightly so that the air deflector can be positioned so that the side support surface 2 and end support surface 8 of the air deflector are stably and securely positioned on the supporting shoulders of the main runners 10 and cross tees 12, the air diffuser 16 thereafter being lowered back into position on top of the air deflector as illustrated in FIGS. 8 and 6B), redirects the airflow away from an undesired location (in this case, the area which would otherwise receive air out of a corner of the air diffuser) and out through the opening 6 at the front of the air deflector, the redirected airflow from the air diffuser being directed to the desired location by the air deflector in this alternative embodiment.

The present invention has been described herein with regard to preferred embodiments. However, it will be obvious to persons skilled in the art that a number of variations and modifications can be made without departing from the scope of the invention as described herein.

What is claimed is:

1. An air deflector system comprising:

an air vent having a face structure through which a flow of air passes;

at least two supporting shoulders positioned adjacent to said air vent; and an air deflector positioned adjacent to said air vent and supported by said at least two supporting shoulders, said air deflector comprising:

at least two support surfaces engaging and being supported by said supporting shoulders; and, a deflector surface coupled to said at least two support surfaces, said deflector surface protruding from a plane defined by said at least two support surfaces and forming one opening between said deflector surface and said plane that is oriented substantially perpendicular to said plane, said air deflector directing only a portion of said flow of air from said air vent through said one opening in a direction oriented approximately parallel to said plane, wherein the portion of air flow directed by said air deflector is substantially less than all air flow passing through the air vent;

wherein each said support surface extends generally outwardly away from said deflector surface, and wherein said deflector surface comprises a single gently curved surface that forms a variable obtuse angle with each adjacent said support surface as it gradually protrudes away therefrom.

2. The air deflector system of claim 1 wherein said supporting shoulders are defined by main runners and cross tees of a suspended ceiling.

3. The air deflector system of claim 1 wherein said deflector surface is in engagement with and supported by only two support surfaces and wherein a projection of said deflector surface onto said plane forms a triangle.

4. The air deflector system of claim 1 wherein said deflector surface is in engagement with and supported by three support surfaces and wherein a projection of said deflector surface onto said plane forms a rectangle.

5. The air deflector system of claim 1 wherein the portion of said air flow directed by said air deflector is substantially smaller than half the air flow passing though the air vent.

6. The air deflector system of claim 1 wherein the portion of air exiting said air vent and not directed by deflector surface is unimpeded by a structure of said air deflector.

7. The air deflector system of claim 1 wherein said air vent is positioned in the ceiling of a building.

8. A method for installing an air deflector comprising:

accessing an air vent having a face structure through which a flow of air passes;

accessing at least two supporting shoulders positioned adjacent to said air vent;

providing an air deflector having at least two support surfaces and a deflector structure coupled to said support surfaces, said deflector structure extending from a plane defined by said two support surfaces and forming an opening positioned between said deflector structure and said plane that is oriented substantially perpendicular to said plane, wherein each said support surface extends generally outwardly away from said deflector structure, and wherein said deflector structure comprises a single gently curved surface that forms a variable obtuse angle with each adjacent said support surface as it gradually protrudes away therefrom; and positioning said air deflector such that said air deflector is supported by said supporting shoulders and positioned adjacent to said air vent such that only a portion of said flow of air from said air vent is directed through said opening in a direction approximately parallel to said plane, wherein the portion of air flow directed by said air deflector is substantially less than all air flow passing through the air vent.

* * * * *